United States Patent [19]

Croteau et al.

[11] 4,455,197

[45] Jun. 19, 1984

[54] STOCK SUPPLY SYSTEM FOR PAPER MACHINE

[75] Inventors: Denis Croteau, St. Francois de Laval; Roman Caspar; Ramamurthy G. Krishnan, both of Beaconsfield; Alexander Malashenko, Dollard des Ormeaux; Rodney H. Bryce, Lachine; Valdur Soomet, Montreal West; Giovanni Deperis, Beaconsfield, all of Canada

[73] Assignee: Dominion Engineering Works Limited, Lachine, Canada

[21] Appl. No.: 447,249

[22] Filed: Dec. 6, 1982

Related U.S. Application Data

[63] Continuation of Ser. No. 246,927, Mar. 24, 1981, abandoned.

[30] Foreign Application Priority Data

Apr. 2, 1980 [CA] Canada ..... 349245

[51] Int. Cl.[3] ..... D21F 1/02; D21F 1/06

[52] U.S. Cl. ..... 162/343; 162/344

[58] Field of Search ..... 162/343, 336, 340, 344, 162/347, 337, 330

[56] References Cited

U.S. PATENT DOCUMENTS

| | | | |
|---|---|---|---|
| Re. 28,269 | 12/1974 | Hill et al. | 162/343 |
| 3,216,892 | 11/1965 | Wahlström | 162/343 |
| 3,486,972 | 12/1969 | Nagell | 162/343 |
| 3,535,203 | 10/1970 | Nilsson | 162/343 |
| 3,725,197 | 4/1973 | Dahl et al. | 162/343 |
| 4,070,238 | 1/1978 | Wahren | 162/343 |

FOREIGN PATENT DOCUMENTS

| | | | |
|---|---|---|---|
| 2852564 | 6/1979 | Fed. Rep. of Germany | 162/343 |

*Primary Examiner*—Steve Alvo

*Attorney, Agent, or Firm*—Raymond A. Eckersley

[57] ABSTRACT

A stock delivery system is provided having a rectangular sectioned distributor of substantially square section connected in stock supplying relation to a headbox having an apertured distributor place, a mixing chamber receiving stock therein connecting by way of a throttle plate to a multi-tier diffuser section comprising cylindrical tubes that diverge to a square section. A parallel flow section of predetermined length connects to a tapered nozzle section. The structural elements of the apparatus, including the support beam, a portion of the diffuser section, and the roof section are connected in liquid transfer relation to permit the passage of liquid a controlled temperature therethrough. Also, the slice is provided with liquid containment capability, and also includes a segmented extension chamber to permit substantially unrestricted later expansion or contraction of the slice under changing thermal conditions.

10 Claims, 7 Drawing Figures

FIG.3.
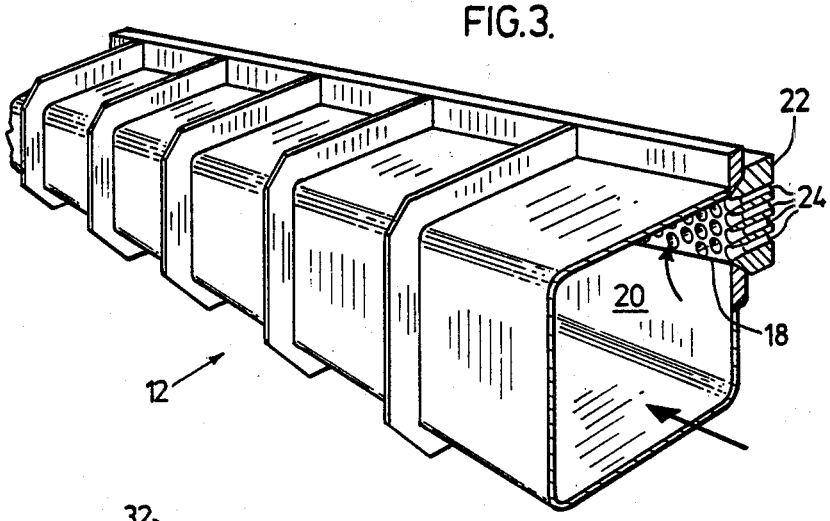
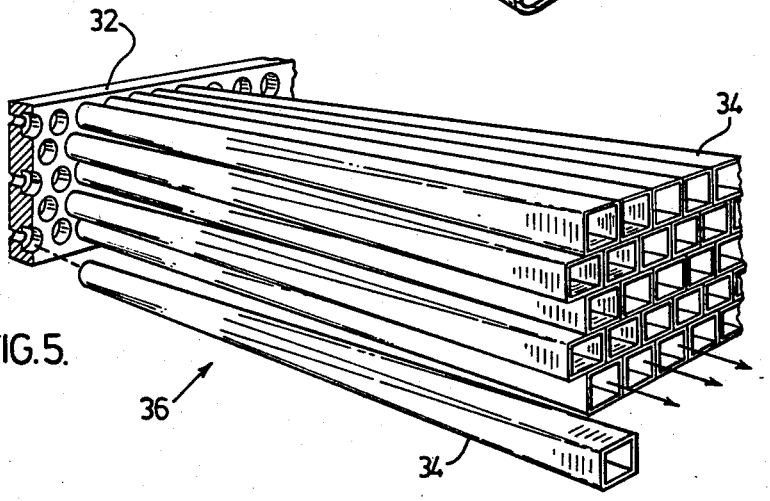
FIG.5.
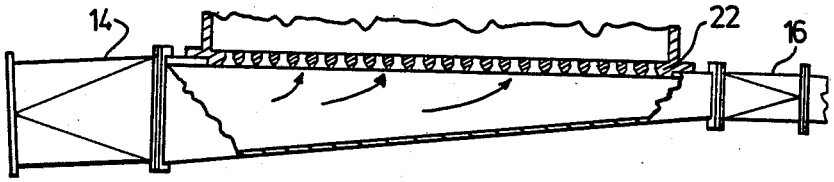
FIG.4.

STOCK SUPPLY SYSTEM FOR PAPER MACHINE

This application is a continuation of application Ser. No. 246,927, filed Mar. 24, 1981 (now abandoned.

This invention is directed to a stock supply system for a paper machine and is directed in particular to a flow distributor in combination with a headbox.

In the art of paper making, wherein a layer of stock is deposited on a moving forming wire or between a pair of forming wires in action, the stock supply system, as regards the flow distributor and the headbox which forms and deposits the layer of stock, plays an extremely important role in the success of the total paper making operation.

In order to maintain the fibres of the stock in the desired random suspension it is necessary to provide microturbulence, i.e. high frequency turbulence to the stock, so as to avoid flocculation. The occurrence of macroturbulence, namely the generation of low frequeny turbulence, is an undesired phenomenon which creates unstable "roping" of the stock as it is deposited from the headbox. It has been found as a general rule that the generation of the desired degree of microturbulence tends to increase the extent of undesired macroturbulence.

Despite the prolixity of prior art, the requirements of the paper industry for particular finish characteristics, and the need of the industry to achieve desired quality at high rates of production have not previously been met.

The presently disclosed apparatus provides a stock supply system wherein an improved balance is obtained between the desired high frequency microturbulence and undesired low frequency macroturbulence. From tests carried out with a model of the presently disclosed headbox and distributor extremely marked reductions were otbained in low frequency turbulence (macroturbulence), compared with other, modern high turbulence headboxes.

In accordance with the present disclosure there is provided an apparatus for supplying stock to a paper making machine comprising; a flow distributor of progressively diminishing rectangular section extending in a cross machine direction having at one end thereof an inlet for connection to a stock supply, an outlet for excess stock located at the other end of the distributor, and an elongated aperture extending in the cross machine direction having an apertured distributor plate extending in covering relation therewith; a headbox in aligned relation with the distributor plate having a mixing chamber in unobstructed flow relation with the apertures of the plate, a diffuser section extending from the mixing chamber having a plurality of layers of tubes of progressively increasing cross section in the downstream direction, including throttle plate means sharp edged orifices thereof in aligned relation with respective ones of the tubes, a parallel flow chamber of predetermined length at the downstream end of the diffuser section to receive stock from the tubes, in operation, and a convergent nozzle terminating at a slice opening, to transfer the stock to a forming section of the machine.

In the embodiment that was tested, the flow distributor was of substantially square section adjacent the inlet.

The apparatus as tested included a transition supply piece having an outlet end thereof connected to the flow distributor inlet, a circular inlet portion thereof connected to a circular stock supply pipe and an intermediate transition portion of predetermined length having an angle of divergence in the cross machine direction of about 5 degrees, to preclude flow separation, the angle not exceeding about 8°.

The distributor back wall and side wall, located remotely from the elongated aperture each progressively diminish in their width, in the cross machine direction, to provide a substantially constant rate of reduction of cross sectional area of the distributor between its inlet and its end outlet.

The distributor plate is of substantially constant cross section across the machine.

Dealing particularly with other characteristics of the headbox, in apparatus having a flow distributor, extending in the cross machine direction and connected in stock supplying relation with a headbox having a mixing chamber, a diffuser section, and terminating at a convergent nozzle, there is provided an apron beam of plates forming a hollow vessel in supporting relation with the headbox and a hollow roof member located on the side of the headbox opposite from the apron beam, and water supply means connected to the interior of the apron beam and the roof member, to maintain the temperature of the structure of the headbox substantially uniform. This arrangement further includes percolation passage means extending between the apron beam and the roof member, to conduct water in heat transfer relation from one to the other upwardly through the headbox. These percolation passage means extend upwardly through the diffuser section of the headbox in sealed relation from the stock, the spaces between adjacent tubes of the diffuser section providing the requisite percolation paths.

In the apparatus the apron beam includes supporting bracket means extending therefrom to support the headbox in pivotal relation thereon. The flow distributor is connected to the apron beam in pivotal relation independently of the headbox, to permit pivotal separation between the flow distributor and the headbox.

The distributor plate is connected by pivotal support means to the flow distributor, to facilitate access thereto for purposes of cleaning.

The apparatus includes an adjustable slice means to control the passage of stock to the machine, having a slice wall forming a portion of said stock passage, pivot means securing the slice wall in pivotal relation to a relatively fixed portion of the headbox, with enclosure walls in sealing relation with the slice wall external to the stock passage, to contain heat transfer liquid therein in temperature moderating relation with the slice wall.

The adjustable slice means has an extension chamber connected thereto comprising a plurality of separately segmented chambers, each connected individually to a portion of one of the slice enclosure walls, to permit substantially unrestrained thermal expansion of the slice wall in the cross machine direction. This slice adjustment is provided by a slice lip bounding the downstream end of the slice wall, connected thereto in substantially sealed parallel sliding relation, having a plurality of positioning bars substantially uniformly spaced across the width of the headbox, each bar having a servo motor connected in longitudinal positioning relation therewith, a finger portion of each bar engaging the slice lip to transmit a sliding force thereto from the respective servo motor, whereby local deformation of the slice lip in response to activation of selected ones of the servo motors may be obtained, so as to provide localized slice control.

Certain embodiments of the herein disclosed apparatus are described, reference being made to the accompanying drawings, wherein:

FIG. 3 is a general view of a portion of the cross machine distributor;

FIG. 4 is a plan view of the distributor of FIG. 3 and its end connection transition pipes to the stock supply;

FIG. 5 is a general schematic view showing elements of the diffuser section of the apparatus in partially assembled relation;

Figure 1:
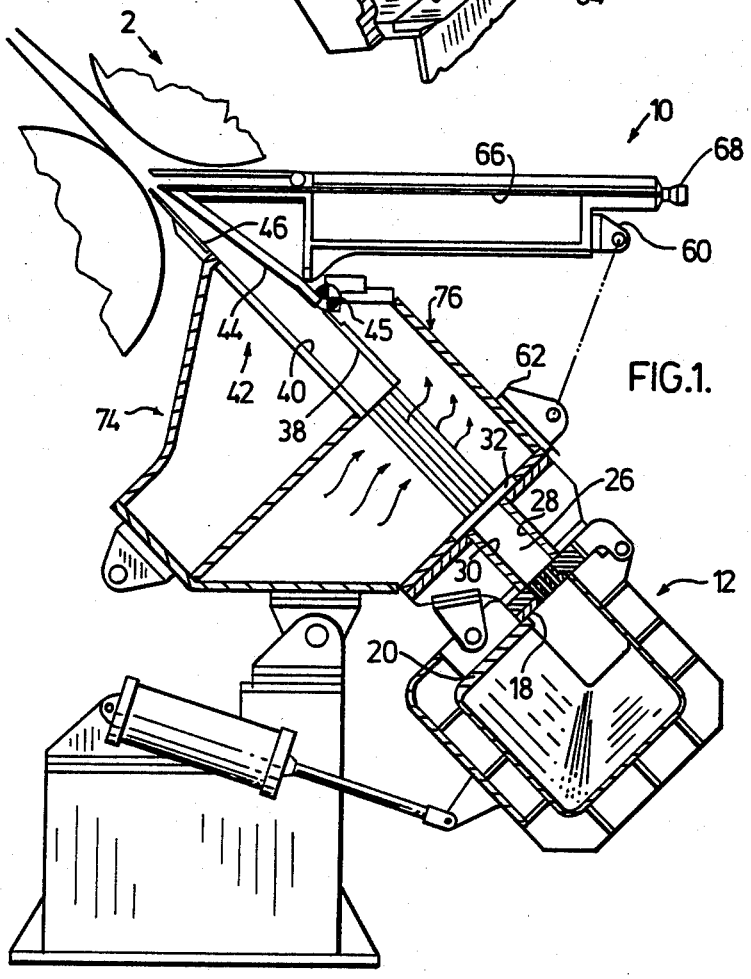
FIG. 1 is a sectioned side view of the arrangement.

Referring to FIGS. 1, 3 and 4, the apparatus 10 is provided with a cross-flow distributor 12 of substantially square cross-section, having connected thereto an inlet transition piece 14 and an outlet transition piece 16 by means of which connection is made to the stock source.

An elongated outlet aperture 18 extends across the front wall 20 of the distributor 12, having an apertured distributor plate 22 thereat. The plate 22 has a plurality of flow passage 24 therein, each passage 24 having a tapered inlet portion and a cylindrical bore extending therefrom in a downstream or stock flow direction.

Downstream from the distributor plate 22 extends a mixing chamber 26, bounded by walls 28, 30 and terminating laterally at a throttle plate 32 (see FIG. 5). A plurality of diffuser tubes 34 having circular upstream ends and rectangular downstream ends are provided, the upstream ends being entered in the plate 32 and the downstream ends being arranged as a multi-tier structure wherein the tube ends are in staggered relation. The flow openings in the throttle plate 32 are of smaller diameter than the inner diameter of the tubes 34, to preclude stapling of fibres thereat.

Downstream from the diffuser section 36 the upper wall portion 38 extends parallel with the lower wall portion 40, to provide a parallel flow chamber of predetermined length for the particular machine.

A nozzle portion 42 includes a moveable slice wall 44, pivoted at 45 and a lower lip 46.

Figure 6:
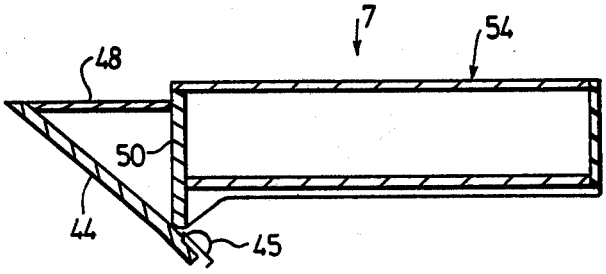
FIG. 6 is a side view, in section of a portion of the slice structure.
Figure 7:
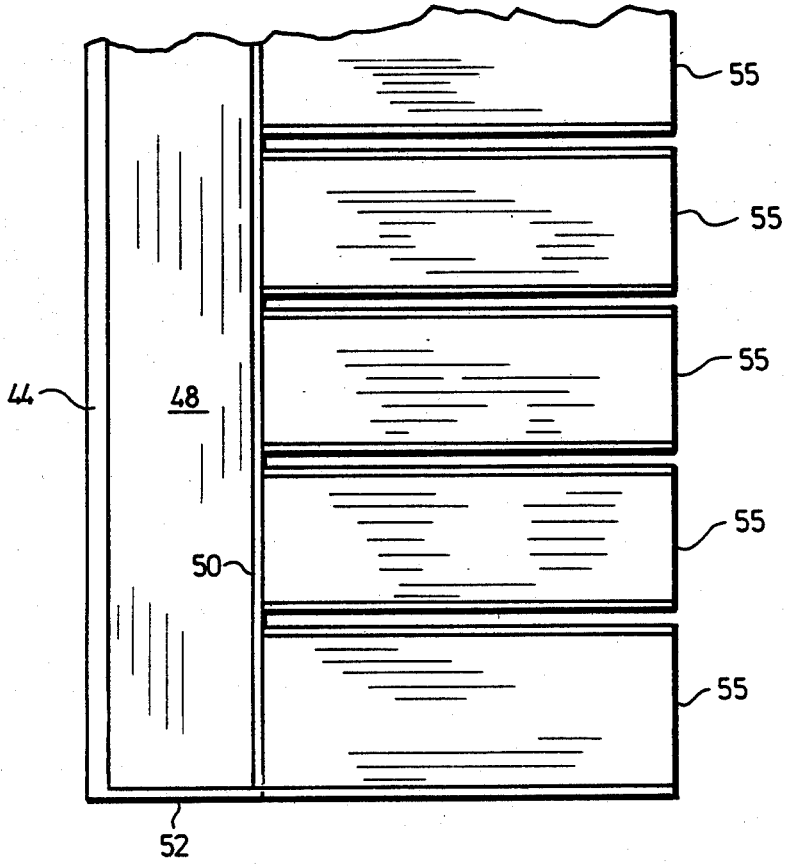
FIG. 7 is a plan view of a portion of the slice arrangement of FIG. 6.

Referring to FIGS. 6 and 7, the slice wall 44 is enclosed externally of the slice opening by enclosure walls 48, 50 which together with end walls 52 provides a cooling chamber to receive water or other liquid therein. Air bleed passages and water supply arrangements are not shown. A slice extension chamber 54 extends rearwardly from the wall 50, having a series of segmented portions 55 whereby the transverse expansion of the wall 44 and its associated box structure 48, 50 is not restricted. Accordingly, the untoward bowing of the slice wall 44 under conditions of thermal expansion is substantially avoided. The chambers 55 also may be liquid filled. A pair of brackets 60, 62 (see FIG. 1) interconnected by an extensible actuator, not shown, provides orientational adjustment of the slice wall 44 about its pivot 45.

Figure 2:
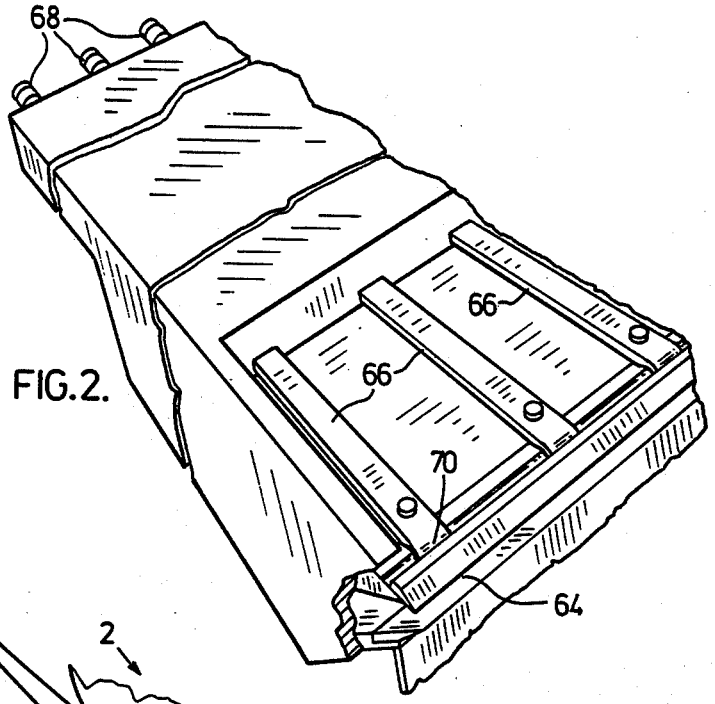
FIG. 2 is a general view, looking from above from the location of arrow 2, showing a portion of the slice adjustment arrangement.

The adjustable slice lip 64 (FIG. 2) is adjusted by actuator bars 66 which are connected to servo motors 68. The bars 66 have finger end portions 70 entered into a slot extending across lip 64. Adjustment of individual ones of the servo motors 68 can provide local correction to the slice opening.

The headbox and distributor 12 are supported upon an apron beam 74 of deep hollow section, having provision for the supply of coolant liquid thereto. The roof means 76 is connected in liquid transfer relation with the interior of the apron beam 74, to which liquid is supplied at a controlled temperature, to maintain the structure under controlled thermal conditions.

The percolation of the thermal control liquid through the headbox takes place by way of the longitudinal gaps extending between the tubes 34 (FIG. 5).

It will be understood that, while outstanding results have been achieved in test, the respective contribution of the cross-flow distributor and the headbox formulation may not be readily determined. Accordingly, the subject matter hereof is treated both in total combination, and for the contribution of the individuated portions of the system.

What we claim as new and desire to secure by Letters Patent of the United States of America is:

1. Apparatus for supplying stock to a paper making machine comprising: a flow distributor of progressively diminishing rectangular section extending a cross machine direction having the larger end thereof as an inlet for connection to a stock supply, the smaller end thereof as an outlet for excess stock, and an elongated aperture extending in the cross machine direction having an apertured distributor plate extending in covering relation therewith; a headbox is aligned relation with the distributor plate having a mixing chamber in unobstructed flow relation with the apertures of the plate, a diffuser section extending from the opposite side of said mixing chamber from said plate, said diffuser section having a plurality of layers of tubes of progressively increasing cross section in the downstream direction, including throttle plate means located at the upstream end of said diffuser section and having orifices thereof in aligned relation and directly connected with respective ones of said tubes, a parallel flow chamber of predetermined length at the downstream end of the diffuser section to receive stock from the tubes, in operation, and a convergent nozzle terminating at a slice opening, to transfer said stock to a forming section of said machine.

2. The apparatus as claimed in claim 1 wherein said flow distributor section is substantially square adjacent said inlet.

3. The apparatus as claimed in claim 2, including a transition supply piece having an outlet end thereof connected to said flow distributor inlet, a circular inlet portion of said supply piece for connecting to a circular stock supply pipe and an intermediate transition wall portion of predetermined length changing from circular section to square section having an angle of divergence from the polar axis of said supply piece not greater than about 8°.

4. The apparatus as claimed in claim 3 wherein said angle of divergence is about 5°, to preclude flow separation.

5. The apparatus as claimed in claim 1, said distributor having a back wall and a side wall each remotely located from said elongated aperture, said back and said side wall each progressively diminishing in the width thereof to provide a substantially constant rate of reduction of cross sectional area of the distributor between said inlet and said outlet.

6. The apparatus as claimed in claim 1, said distributor plate having a substantially constant open cross section so that uniform stock flow is obtained through said plate across the machine.

7. A headbox as defined in claim 1 wherein each of said orifices in said throttle plate means is of smaller diameter than the inside diameter at the immediately adjacent end of the respective tube into which it empties.

8. A headbox as defined in claim 1 wherein said diffuser tubes at said throttle plate are circular in cross-section and surround their respective orifices at their upstream ends and at their downstream ends are square and have substantially vertical side walls.

9. A headbox as defined in claim 8 wherein tubes in one layer are laterally offset related to the tubes in the next offset layer.

10. A headbox as defined in claim 9 where offset is equal to one half the width of said tubes.

* * * * *